United States Patent [19]

Rembold

[11] Patent Number: 4,982,706

[45] Date of Patent: Jan. 8, 1991

[54] VALVE CONTROL APPARATUS HAVING A MAGNET VALVE FOR INTERNAL COMBUSTION ENGINES

[75] Inventor: Helmut Rembold, Stuttgart, Fed. Rep. of Germany

[73] Assignee: Robert Bosch GmbH, Stuttgart, Fed. Rep. of Germany

[21] Appl. No.: 548,406

[22] Filed: Jul. 5, 1990

[30] Foreign Application Priority Data

Sep. 1, 1989 [DE] Fed. Rep. of Germany ..... 3929073

[51] Int. Cl.[5] ..... F01L 1/12; F01L 1/24; F02D 13/02

[52] U.S. Cl. ..... 123/90.12; 123/90.16

[58] Field of Search ..... 123/90.12, 90.13, 90.15, 123/90.16

[56] References Cited

U.S. PATENT DOCUMENTS

| | | | |
|---|---|---|---|
| 3,727,595 | 4/1973 | Links | 123/90.12 |
| 4,466,390 | 8/1984 | Babitzka et al. | 123/90.16 |
| 4,674,451 | 6/1987 | Rembold et al. | 123/90.16 |
| 4,696,265 | 9/1987 | Nohira | 123/90.12 |
| 4,716,863 | 1/1988 | Pruzan | 123/90.12 |
| 4,765,288 | 8/1988 | Linder et al. | 123/90.16 |
| 4,889,084 | 12/1989 | Rembold | 123/90.12 |

*Primary Examiner*—David A. Okonsky
*Assistant Examiner*—Weilun Lo
*Attorney, Agent, or Firm*—Edwin E. Greigg

[57] ABSTRACT

A hydraulic valve control apparatus for internal combustion engines, having a reservoir magnet valve for controlling a volume of fluid in a stroke transmission chamber, in order to control a time cross section of a motor valve, wherein a valve element, embodied as a reservoir piston is loaded by a reservoir spring that serves as a closing spring, and a permanent magnet is provided that keeps the valve element in an open position counter to a force of the closing spring when the magnet coil is without current.

20 Claims, 1 Drawing Sheet

VALVE CONTROL APPARATUS HAVING A MAGNET VALVE FOR INTERNAL COMBUSTION ENGINES

BACKGROUND OF THE INVENTION

The invention is based on a valve control apparatus having a magnet valve for internal combustion engines as defined hereinafter.

In a previous valve control apparatus, for controlling the closing and opening time of a motor valve, actuated by a valve control cam of a camshaft via an axially displaceable valve shaft (German Patent Application No. 38 15 668.7, now U.S. Pat. No. 4,889,084), the liquid reservoir is integrated with the magnet valve, and the valve element serves as a reservoir piston that divides a reservoir chamber from a magnet chamber; the communication between the valve inlet and the reservoir chamber is controlled via one end edge of the reservoir piston in cooperation with the valve seat. The magnet acts counter to the reservoir deflection direction, because in this special exemplary embodiment the magnet valve is intended to be open when without current or in other words to be blocked only when voltage runs through it. This is intended to assure that the motor cannot race should the plug fall off the magnet valve. Achieving the embodiment of the invention as set forth above, in which on the one hand the fluid reservoir is integrated with the magnet valve and on the other the magnet valve is intended to be open when without current, entails considerable expense, in particular for construction, above all because at least two springs must engage the reservoir piston serving as the valve element. If the spring acting in the valve opening direction is to be accommodated within the magnet valve, the region of the reservoir chamber located underneath the valve seat must have a minimum structural size. Since this region is always filled with hydraulic fluid, however, the result is not an enlargement in the reservoir chamber but rather a disadvantageous enlargement of the total structural size of the magnet valve.

OBJECT AND SUMMARY OF THE INVENTION

The valve control apparatus according to the invention, has an advantage by comparison that the combined reservoir valve unit is simpler in structure, and that it uses only a reservoir spring.

The permanent magnet in this invention performs the function of the second spring, by exerting a force upon the valve element counter to the reservoir spring that is so great that the valve element is kept in the valve open position when the electromagnet is not excited. By excitation of the electromagnet, a magnetic field oriented counter to the magnetic field of the permanent magnet and of at least the same magnitude is generated. As a result, the magnetic field of the permanent magnet is neutralized, and the magnet valve is closed by the force of the closing spring.

The permanent magnet is advantageously disposed on an end of the valve element remote from the reservoir chamber, so that the end face of the valve element exposed to the hydraulic pressure can be shaped flat, and the unusable reservoir space located underneath the valve seat can be kept small.

In an advantageous feature of the invention, the reservoir piston is embodied as cup-shaped and has a cup bottom, oriented toward the reservoir chamber, the edge of the cup shaped bottom cooperates with a valve seat provided between a valve inlet and a reservoir chamber and is radially guided on an inner wall of the control valve housing; and as a magnet yoke, a central tang attached to the housing plunges into the cup opening of the reservoir piston. By a corresponding embodiment of the outer face of the tang and of the inner face of the cup, the magnetic flux and thus the magnetic forces can be optimized. Moreover, a favorable distribution of space is attained, which contributes to making the reservoir and magnet valve unit smaller.

In another advantageous feature of the invention, the magnet coil is disposed in the magnet space formed between the tang and the inner wall, which makes assembly of the reservoir and magnet valve unit simpler, but also makes it possible to minimize the structural volume.

In another advantageous feature of the invention, the permanent magnet is integrated into the solid tang serving as a yoke of the electromagnet, which enables further minimization of the structural volume.

In yet another advantageous feature of the invention, a central bore is present in the tang, for relieving the magnet chamber; this has considerable advantages in terms of connection.

In another advantageous feature of the invention, a throttle opening is present in the cup bottom that divides the magnet chamber from the reservoir chamber, in order to assure that the reservoir piston will again come sealingly to rest upon the valve seat once the tappet chamber pressure has been lowered. In another advantageous feature of the invention, the tang can serve as a stroke stop of the reservoir piston and can furthermore have a blind bore into which the reservoir spring plunges partway. This blind bore can be at least deep enough that it entirely receives the reservoir spring whenever this spring is compressed into a block. This saves even more space, to the advantage of the volume of the reservoir chamber.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
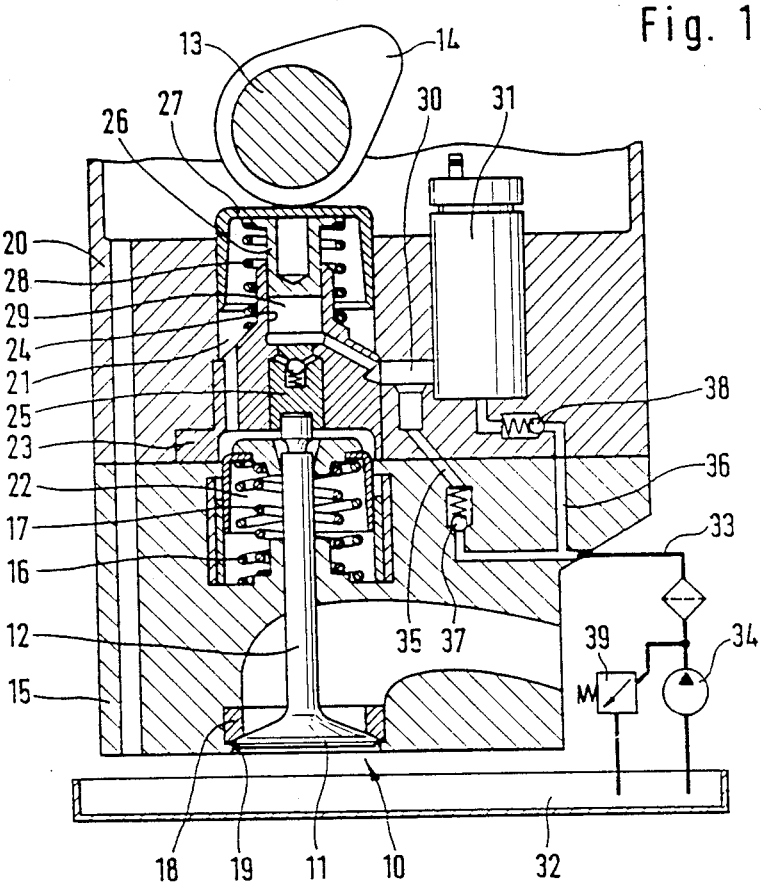
FIG. 1 is a longitudinal section through a valve control apparatus, with a reservoir and magnet valve unit shown in full view.

The valve control apparatus for an inlet or outlet valve 10 of an internal combustion engine is disposed between a valve shaft 12 carrying a valve element 11, and a valve control cam 14 that revolves with a camshaft 13. The valve shaft 12 is axially displaceably guided in a valve housing 15; with the valve element 11, under the influence of two coaxial valve closing springs 16, 17, the valve element rests on a valve seat 18 in the valve housing 15, the valve seat surrounds a valve inlet or outlet opening 19. The valve control apparatus has a control housing 20, mounted on the valve housing 15 shown by opposite cross-hatching, in which housing a housing chamber 21 is disposed coaxially with a spring chamber 22 in the valve housing 15, the valve closing springs 16, 17 are accommodated coaxially with each other in the valve housing. A housing block 23, which has a central axially continuous housing bore 24, is thrust from below into the housing chamber 21. A valve piston 25 is connected to the valve shaft 12 and a piston portion 26 of a cam piston 27 disposed above the valve piston 25 are axially displaceable in the housing bore 24. The cam piston 27 is pressed against the valve control cam 14 by a restoring spring 28 supported by housing block 23. The piston portion 26 is pressed formfittingly against the cam piston 27 via the restoring spring 28. The valve piston 25 and the piston portion 26 define an oil-filled stroke transmission chamber 29, the effective axial length of which between the cam piston 27 and the valve piston 25 can be varied by relative motion of the piston with respect to one another. The stroke transmission chamber 29 communicates via a line 30 with a cylindrically embodied magnet control valve 31, which is shown in full view in FIG. 1, the line 30 abutting radially against the magnet control valve 31. Any amount of leakage of the oil flowing out of the valve control apparatus is compensated for, from a supply container 32, via a feed line 33 by means of a feed pump 34; the line 33 branches into a line 35, which discharges into the line 30 connecting the stroke transmission chamber 29 and the magnet control valve 31, and a line 36, which leads to the magnet control valves 31, specifically to the lower face end thereof. One one-way check valve each 37 and 38, opening toward the magnet control valve 31, is disposed in the lines 35 and 36. An upward limit on the maximum pumping pressure of the feed pump 34 is set by a pressure limiting valve 39, so that a predetermined oil supply pressure will not be exceeded.

Figure 2:
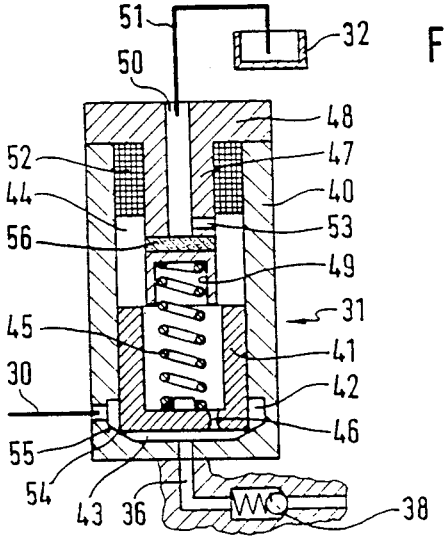
FIG. 2 is a longitudinal section through the reservoir and magnet valve unit on a larger scale.

By means of the magnet control valve 31, which is shown in section in FIG. 2, the quantity of oil present in the stroke transfer chamber 29 can be controlled. To this end, a cup-shaped reservoir piston 41 is disposed axially displaceably and radially sealingly in the magnet valve housing 40. In the closed position of the magnet valve 31 shown, this reservoir piston 41 divides an inlet chamber 42 from a reservoir chamber 43 and a magnet chamber 44. The reservoir piston 41 is loaded by a reservoir spring 45 also acting as a closing spring, and on the piston bottom i& has a throttle bore 46, by means of which the reservoir chamber 43 and the magnet chamber 44 are made to communicate with one another. On its end remote from the reservoir piston 41, the reservoir spring 45 is supported on a tang 47, disposed coaxially with the reservoir piston 41, of a housing cap 48; a blind bore 49 is provided on the free end of the tang 47 in order to receive a portion of the reservoir spring 45. A leakage conduit 50 is also present in the tang 47, leading via a leakage line 51 to the oil container 32. A magnet coil 52 is disposed in the annular chamber of the magnet chamber 44 formed by the magnet valve housing 40 and tang 47. This annular chamber, into which the reservoir piston 41 plunges with its annular walls upon displacement counter to the reservoir spring 45, also communicates via a leakage bore 53 with the leakage conduit 50, in order to avoid any backup of fluid between the magnet coil 52 and reservoir piston 41 inside the magnet chamber 44 when the piston 41 plunges into this chamber. A permanent magnet 56, which exerts an attractive force upon the reservoir piston 41 counter to the force of the reservoir spring 45, is disposed in the tang 47, between the blind bore 49 and the leakage bore 53.

The valve control apparatus described operates as follows:

With the magnet valve 31 closed by excitation of the coil 52, the valve plate 11 of the valve element 11 is lifted outwardly away from the valve seat by the cam 14 at the intended instant for operation of the engine, and the inlet conduit to the combustion chamber is opened. To this end, via the cam piston 27 and counter to the force of the restoring spring 28, the piston portion 26 is displaced into the housing bore 24, which is filled with oil. Because of the oil, which is a virtually inelastic force transmitter, the valve piston 25 is positively displaced downward and in this process displaces the valve shaft 12, including the valve plate, counter to the force of the valve closing springs 16 and 17. With an unchanged volume of fluid in the stroke transmission chamber 29, the opening stroke of the motor valve 10 is equivalent to the height of the valve control cam 14, because the piston portion 26 and the valve piston 25 have the same operating diameter. This operating stroke of the valve shaft 12 is then varied by the magnet control valve 31 whenever the time cross section between the valve plate and valve seat 18 is sufficiently large, for instance if the engine rpm is to be reduced by reduction of this time cross section. In accordance with the time cross section, the quantity of fuel and air mixture aspirated into the combustion chamber is decreased. In order to shorten this time cross section, the magnet valve 31 is purposefully opened beyond a predetermined working stroke, by switching off the coil 52 and by the lifting of the valve edge 54 of the reservoir piston 41 from the valve seat 55 as a result of the action of the magnetic field of the permanent magnet 56, so that the pressure prevailing in the stroke transmission chamber 29 is transmitted via the line 30 into the reservoir chamber 43, where, by action upon the lower end of the reservoir piston 41 it displaced this piston upward, counter to the force of the reservoir spring 45. The volume in the stroke transmission chamber 29 is reduced by this volume received by the reservoir. By the action of the springs 16 and 17, the valve plate closes earlier, as a result. Moreover, with this reservoir process in the combined reservoir and magnet valve 31, fluid present in the magnet chamber 44 is carried to the oil container 32 via the leakage bore 53 or leakage conduit 50 and the leakage line 51 Upon further rotation of the valve control cam 14, this cam reaches the base circle position shown, in which the piston portion 26 has once again been displaced all the way upward by the restoring spring 8. In this motion, the reservoir piston 41 of the magnet control valve 31, driven by the reservoir spring 45, positively displaces the oil stored ahead of it, back via the line 30, into the stroke transmission chamber 29. By excitation of the coil 2, a magnetic field oriented counter to and at least at the same magnitude as the magnetic field of the permanent magnet 56 is generated, thereby neutralizing the effect of the permanent magnet field, and the reservoir piston 41 is forced with its valve edge 54 onto the valve seat 55 by the force of the reservoir spring 45. Any voids arising in the valve inlet chamber 42 of the line 30 or in the stroke transmission chamber 29 are filled with oil via the feed pump 34 and the feed line 33, and a reverse flow is prevented by the check valve 37, so that upon being driven again by the valve control cam 14, the outset situation is again attained. Via the throttle bore 46 in the bottom of the reservoir piston 41, it is attained that no backup pressure arises in the reservoir chamber 43; that is, the reservoir piston 41 rests flush on the valve seat 55. Via the line 36 and the check valve 38, oil flows continuously from the feed pump 34 into the reservoir chamber 43 and from there via the throttle bore 46 into the magnet chamber 44 and back into the oil container 32, thereby assuring a continuous filling of the reservoir chamber 43, at a constant, low pressure.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the U.S. is:

1. A valve control apparatus for controlling the closing and opening time of an internal combustion engine motor valve actuated by a valve control cam of a camshaft via an axially displaceable valve shaft, having a fluid-filled stroke transmission chamber disposed in a housing block between the valve control cam and the valve shaft, a conduit in said housing block to said stroke transmission chamber for varying its effective axial length between the valve control cam and the valve shaft, a magnet valve for controlling fluid flow to and from said stroke transmission chamber, said conduit discharges at one end into a fluid reservoir, said fluid reservoir is embodied by a backward deflection of a valve element which serves as a reservoir piston in an opening direction, past a position uncovering a flow opening, into said magnet valve, said valve element, embodied as said reservoir piston (41), is loaded by a reservoir spring (45) serving as a closing spring (45), and a permanent magnet (56) is provided which keeps the valve element in an open position counter to the force of the closing spring when the magnet coil (52) is without an excitation current.

2. A valve control apparatus as defined by claim 1, in which said reservoir piston (41) is embodied as cup-shaped and has a cup bottom oriented toward the reservoir chamber (43), said cup bottom includes an outer edge (54) which cooperates with a valve seat (55) provided between a valve inlet chamber (42) and a reservoir chamber (43), and said reservoir piston is radially guided on an inner wall of the control valve housing (40), and that a central tang (47) attached to the housing plunges, as a magnet yoke into the cup opening of the reservoir piston (41).

3. A valve control apparatus as defined by claim 2, in which said magnet coil (52) is disposed in an annular chamber of a magnet chamber (44) formed between the tang (47) and an inner wall of the housing (40).

4. A valve control apparatus as defined by claim 2, in which said permanent magnet (56) is integrated with the central tang (47) which serves as a magnet yoke of the electromagnet.

5. A valve control apparatus as defined by claim 3, in which said permanent magnet (56) is integrated with the central tang (47) which serves as a magnet yoke of the electromagnet.

6. A valve control apparatus as defined by claim 2, in which said control tang includes a central bore (50) for relieving the magnet chamber (44).

7. A valve control apparatus as defined by claim 3, in which said control tang includes a central bore (50) for relieving the magnet chamber (44).

8. A valve control apparatus as defined by claim 4, in which said control tang includes a central bore (50) for relieving the magnet chamber (44).

9. A valve control apparatus as defined by claim 5, in which said control tang includes a central bore (50) for relieving the magnet chamber (44).

10. A valve control apparatus as defined by claim 1, in which a throttle opening (46) is provided in said cup bottom of the reservoir piston 41 which cup bottom divides the magnet chamber (44) and the reservoir chamber (43).

11. A valve control apparatus as defined by claim 2, in which a throttle opening (46) is provided in said cup bottom of the reservoir piston 41 which cup bottom divides the magnet chamber (44) and the reservoir chamber (43).

12. A valve control apparatus as defined by claim 3, in which a throttle opening (46) is provided in said cup bottom of the reservoir piston 41 which cup bottom divides the magnet chamber (44) and the reservoir chamber (43).

13. A valve control apparatus as defined by claim 4, in which a throttle opening (46) is provided in said cup bottom of the reservoir piston 41 which cup bottom divides the magnet chamber (44) and the reservoir chamber (43).

14. A valve control apparatus as defined by claim 6, in which a throttle opening (46) is provided in said cup bottom of the reservoir piston 41 which cup bottom divides the magnet chamber (44) and the reservoir chamber (43).

15. A valve control apparatus as defined by claim 2, in which said central tang (47) serves as a stroke stop of the reservoir piston (41), and that the reservoir spring (45) plunges partway into a blind bore (49) of the central tang (47).

16. A valve control apparatus as defined by claim 3, in which said central tang (47) serves as a stroke stop of the reservoir piston (41), and that the reservoir spring (45) plunges partway into a blind bore (49) of the central tang (47).

17. A valve control apparatus as defined by claim 4, in which said central tang (47) serves as a stroke stop of the reservoir piston (41), and that the reservoir spring (45) plunges partway into a blind bore (49) of the central tang (47).

18. A valve control apparatus as defined by claim 5, in which said central tang (47) serves as a stroke stop of the reservoir piston (41), and that the reservoir spring (45) plunges partway into a blind bore (49) of the central tang (47).

19. A valve control apparatus as defined by claim 6, in which said central tang (47) serves as a stroke stop of the reservoir piston (41), and that the reservoir spring (45) plunges partway into a blind bore (49) of the central tang (47).

20. A valve control apparatus as defined by claim 10, in which said central tang (47) serves as a stroke stop of the reservoir piston (41), and that the reservoir spring (45) plunges partway into a blind bore (49) of the central tang (47).

* * * * *